United States Patent [19]

Fogleman et al.

[11] Patent Number: 4,671,086

[45] Date of Patent: Jun. 9, 1987

[54] REDUNDANT ELECTRICALLY CONTROLLED LOCKING APPARATUS

[75] Inventors: H. Frank Fogleman; Randall E. Parrish, both of San Diego, Calif.

[73] Assignee: Protech Partnership, San Diego, Calif.

[21] Appl. No.: 726,734

[22] Filed: Apr. 25, 1985

Related U.S. Application Data

[63] Continuation-in-part of Ser. No. 723,547, Apr. 15, 1985.

[51] Int. Cl.[4] ..... E05B 47/06; E05B 49/00

[52] U.S. Cl. ..... 70/277; 70/279; 292/144

[58] Field of Search ..... 70/277, 279, 282; 292/144, 201

[56] References Cited

U.S. PATENT DOCUMENTS 2,953,689 9/1960 Becker ..... 70/282
3,893,723 7/1975 Boule ..... 292/144

FOREIGN PATENT DOCUMENTS 978228 11/1975 Canada ..... 292/144
10345 of 1910 United Kingdom ..... 292/144

*Primary Examiner*—Leslie Braun
*Assistant Examiner*—John Malcolm White
*Attorney, Agent, or Firm*—Bernard L. Kleinke

[57] ABSTRACT

An apparatus for releasing a locking arrangement in response to an electrical control signal to unlock a closure member, employs a pair of first and second piston cylinder assemblies that are facing one another and disposed in alignment with one another within a housing for actuating alternatingly in response to the control signal. The assemblies have reciprocatively mounted plungers for moving extensively toward and away from one another along a rectilinear path of travel. A shuttle is slideably mounted within the housing and connected on opposite sides to the distal ends of the plungers to move toward an actuated one of the cylinder assemblies. A locking cam disposed on the shuttle receives and locks a roller to position the roller partially outwardly of the housing within a side opening in the housing, and a pair of first and second unlocking cams enable the roller to move inwardly of the housing when either one of the cylinder assemblies is activated. The locking arrangement includes a locking mechanism with a slide member that is adapted to be moved manually for releasing the closure member, and the slide member has an opening for receiving the roller to lock the closure member.

19 Claims, 6 Drawing Figures

233
253
306
247
231
246
252
234
249
218
210
214
212
236
361
237
363
255
238
243
245
257
216
221
241
229
227
232A
235
232
225B
25A
223
309
225
230
212
210

318
310
322
270
302
304
300
314
306
271A
331A
290A
294A
293
292
299
329A
292A
325
404
295
410
329
294B
331B
296
295A
298
308
290B
271B
289

REDUNDANT ELECTRICALLY CONTROLLED LOCKING APPARATUS

CROSS-REFERENCES TO RELATED APPLICATIONS

This application is a continuation-in-part of the co-pending and commonly assigned U.S. Patent application entitled "ELECTRICALLY CONTROLLED LOCKING APPARATUS AND SAFE UTILIZING SAME", Ser. No. 723,547 filed Apr. 15, 1985. It is related to the co-pending and commonly assigned U.S. patent application entitled "SAFES", Ser. No. 716,331, filed Mar. 26, 1985.

TECHNICAL FIELD

This invention relates generally to a redundant electrically controlled locking apparatus, and particularly to such an apparatus for lockable doors, such as safe doors.

BACKGROUND ART

Electrically controlled locking mechanisms for lockable doors, such as safe and vault doors, are particularly convenient in many respects for fast access purposes. The keys on a key pad disposed on the front of the door, are depressed in a correct sequence to enter a pre-assigned access code manually, so that the door can be released.

An electrical control circuit responds to the correct sequence of keys being depressed, to activate a solenoid for causing the door to be released. However, should the solenoid malfunction, or otherwise become inoperative, the door could not readily be opened, without the need for maintenance. In certain applications, such as a bank vault or a safe used at a business, such a delay is extremely inconvenient, if not intolerable.

In an attempt to overcome this problem, separate mechanical controls have been provided as a backup means for releasing the door in the event of an electrical control malfunction. Such an alternate mode of access is shown and described in the foregoing mentioned co-pending patent applications.

Although providing a separate mechanical door release enables another means of gaining entry apart from the electrical controls such an approach is not an entirely satisfactory solution. For example, mechanical controls, such as a key lock or combination lock, require the assistance of supervisory or other authorized personnel having the key or combination to be summoned to release the door each time access is required. Such a procedure is highly unsatisfactory for many applications due to the added time and effort required in gaining entry.

Consequently, it is desirable to have an improved electrically controlled locking apparatus that alleviates these concerns. In this regard, it is highly desirable to have such an apparatus that can function substantially in a normal manner despite a malfunction of an electrical component, such as a door releasing solenoid that often times is subject to failure after repeated use. Moreover, it is desirable to know of such a failure so that repair can be undertaken at a later and more convenient time before it becomes necessary to use the mechanical controls. In short, should a component, such as the solenoid fail, then fast access by utilizing the electronic control should still be available and, at the same time, it should become apparent that a failure has occurred.

DISCLOSURE OF THE INVENTION

Therefore, the principal object of the present invention is to provide a new and improved apparatus for releasing a locking arrangement in response to an electrical control signal, even after an electrical component, such as a door releasing solenoid malfunction.

It is another object of the present invention to enable such apparatus, to alert a user that a failure has occurred and thus that the apparatus requires repairing, even though it functions substantially normally.

The above and further objects of the pesent invention are realized by providing an apparatus employing a pair of redundant electromechanical components in the form of piston cylinder assemblies are actuated alternately and independently by an electrical control circuit to release an associated locking arrangement for a closure member each time a correct access code is entered by the user. Since the redundant piston cylinder assemblies (solenoids) are each capable of releasing the locking mechanism, the apparatus can function substantially normally, even though one of the two assemblies should fail.

The pair of piston cylinder assemblies face one another and are disposed in alignment with one another within a housing. The assemblies have reciprocatively mounted plungers for moving extensively toward and away from one another along a rectilinear path of travel. A shuttle is slideably mounted within the housing and is connected on opposite sides to the distal ends of the plungers to move toward an actuated one of the cylinder assemblies. A locking cam disposed on the shuttle receives the roller to position it partially outwardly of the housing within a side opening thereof, and a pair of first and second unlocking cams or the shuttle enable the roller to move inwardly of the housing, when either one of the cylinder assemblies is activated.

The apparatus functions with a locking arrangement that includes a locking mechanism having a slide member adapted to be moved manually for releasing the closure member. The slide member includes an opening for receiving the roller to lock the closure member in place, thereby preventing the closure member from being released or opened. By sliding the shuttle, the roller is selectively urged into or out of alignment with the opening by means of the cams, to lock or unlock the mechanism.

When a correct access code is entered, one piston assembly unlocks the locking arrangement by moving the shuttle in one direction, and the next time a correct access code is entered, the other assembly unlocks it by moving the shuttle in the opposite direction. This alternating action enables the apparatus of the present invention to release the locking arrangement, even though one of the assemblies has failed. In this regard, should one assembly fail, the locking arrangement can be released every other time the correct access code is entered. Thus, a substantially normal mode of operation can be achieved, and at the same time, the user is alerted to the fact that a failure has occurred, since it requires two attempts to release the closure member. The apparatus can function substantially normally, until it can be repaired at a convenient time.

BRIEF DESCRIPTION OF THE DRAWINGS

The above-mentioned and other objects and features of the invention and the manner of achieving them will become apparent and the invention itself will be best understood by reference to the following description of an embodiment of the invention taken in conjunction with the accompanying drawings, wherein.

BEST MODE FOR CARRYING OUT THE INVENTION

Figures 1, 2:
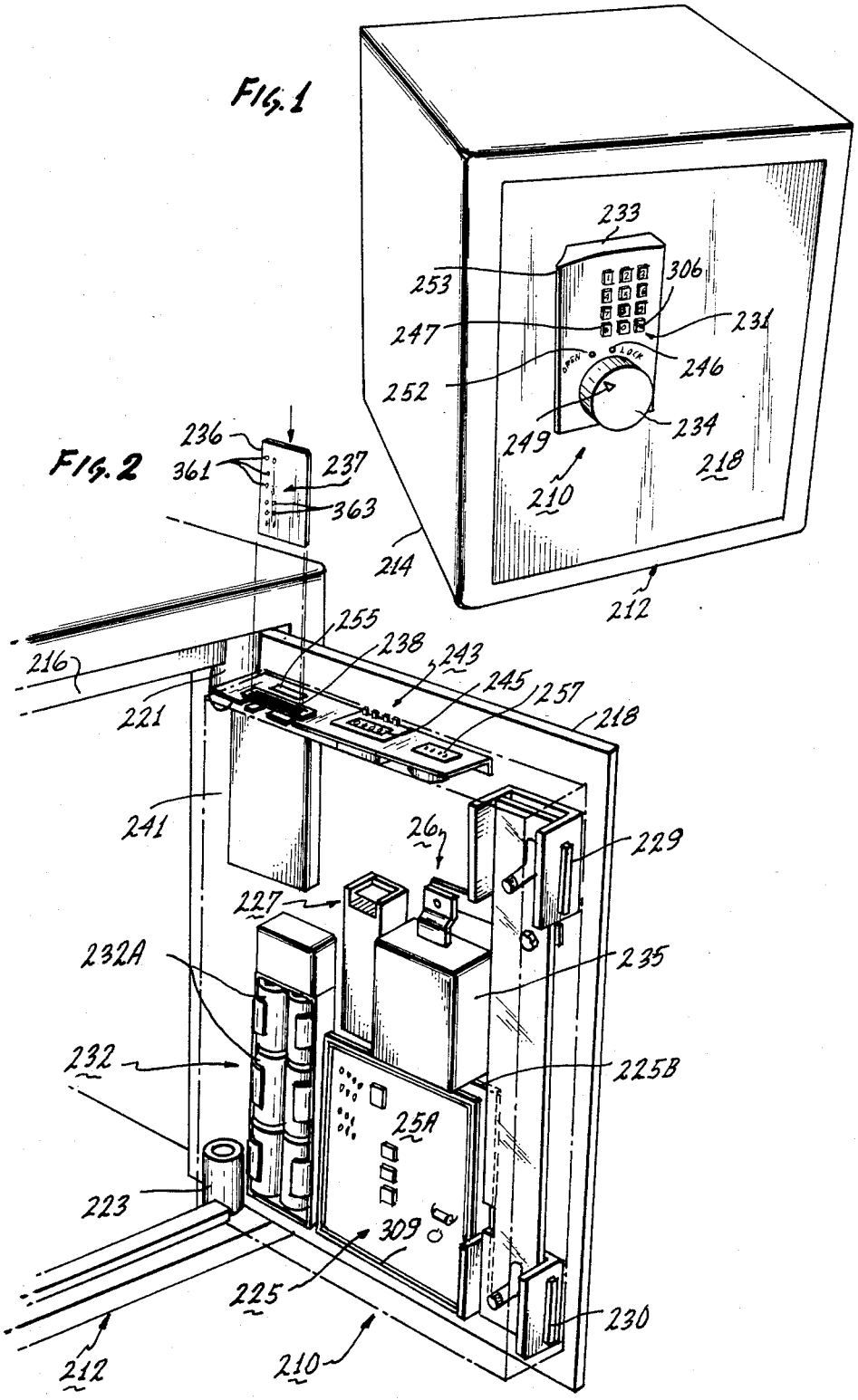
FIG. 1 is a pictorial view of an electrically controlled locking apparatus that employs a redundant locking apparatus which is constructed in accordance with the present invention, and which is incorporated in a door of a safe.
FIG. 2 is an enlarged, fragmentary pictorial view of the portion of the redundant locking apparatus mounted on the rear side of the safe door, with the safe door illustrated in an opened position.

Referring now to FIGS. 1 and 2, there is shown an electrically controlled locking apparatus 210 including redundant locking system 227, which is constructed according to the present invention, and which is incorporated in an "in-room" hotel or motel safe 212. The redundant locking system 227 is substituted for the apparatus 10 of the first-mentioned co-pending parent patent application.

The reference characters used in the present application to designate similar components of the parent application are exactly 200 greater than the corresponding reference characters used in the parent application. For example, the locking apparatus of the present application is reference character 210, and the corresponding locking apparatus of the parent application is reference character 10. Thus, for a more complete description of the safe 212, reference may be made to the disclosure of the safe 12 of the co-pending parent application. While the locking apparatus 210 is shown and described to be incorporated into and forming a part of the safe 212, it will become apparent to those skilled in the art that the locking apparatus 210 is designed for multiple modes of operation, such as personal use safes, coin operation and multi-user applications. In general, apparatus 210 may be employed for locking many different types and kinds of protected areas, such as doors of buildings, safes, vaults and the like.

The safe 212 generally comprises a box or enclosure 214 having a front vertical door access opening 216 (FIG. 2). A vertically-disposed door or closure panel 218 is hingedly mounted on the side of the front opening 216 at pivot points 221 and 223 to swing about a vertical axis between an opened position as shown in FIG. 2, and the closed position shown in FIG. 1.

The electronic locking device 210 generally comprises a control circuit 225 embodied in a printed circuit board 225A, mounted on the backside of the door 218, for activating, through a linkage mechanism 226 and the system 227, as hereinafter described in greater detail, to cause a pair of reciprocating locking bars or bolts 229 and 230, to move selectively into or out of engagement with a pair of respective recesses or openings at the side of the front door opening 216 of the box 212 when the door 218 is closed. A telephone like keypad 231 mounted on a faceplate 233 on the front of the door 218, enables an access code to be supplied to the circuit 225 by a user, to cause the bolt to be released permitting access to the interior of the box 214. A battery power supply arrangement 232, including batteries 232A, provides an alternate electrical power source for the apparatus 210.

The illustrated electrically controlled apparatus 210 includes a mechanical combination lock 235 mounted on the back side of the door 218 and activated by a knob 234 rotatably mounted on the faceplate 233 at the front side of the door 218. For a more detailed description of the mechanical lock assist arrangement (backup mechanical controls for gaining access), including the linkage mechanism 226 and the lock 235, reference may be made to the second-mentioned co-pending application. As more fully described in the second co-pending application, the door 212 can be unlocked, either by entering an access code into the keypad 231 for the control circuit 225, or by rotating the knob 234 for activating the mechanical lcok 235. Ordinarily, different access codes may be employed for the control circuit 225 and the mechanical combination lock 235.

In order to program a desired personal access code in the control circuit 225 for enabling the door to be released, a user authorization card 236 bearing coded user authorization information generally indicated at 237, is first inserted manually into a slot 238 of a card reader 241, mounted on the back of the door 218. In response thereto, the circuit 225 can determine that the user is authorized and then prepares for an initialization operation, during which an authorized user is permitted to store his or her own personal access code in the control circuit 225.

A digitally encodable electrical input device 243, in the nature of "display switches", has a digital read-out display 245, and enables a devised four digit personal access code to be entered manually therein and stored in a non-volatile manner. The device 243 comprises a series of encoders, such as four or six conventional binary coded decimal mechanical encoders. These encoders serve as a non-volatile device for storing the access code, and for displaying the code visually on the protected inside of the door, or controlled access compartment (not shown).

Once the new four digit access code is arranged in the display switches, the door can be released thereafter under electronic control, by entering that same four digit code into the keypad. The display 245 disposed in the protected area behind the door 218, permits an authorized user, after opening the door 218 by means of the knob 234 and the mechanical lock 235, to read the code from the display 245. Thus, should the user not remember the access code, the door can be released by means of the mechanical lock 235, and thus the access code for the control circuit 225 can be learned by an authorized person opening the door and observing the code indicated by the display 245.

For a more detailed description of the mechanical construction of the electrically controlled locking apparatus, reference may be made to the second-mentioned co-pending patent application.

Figure 3:
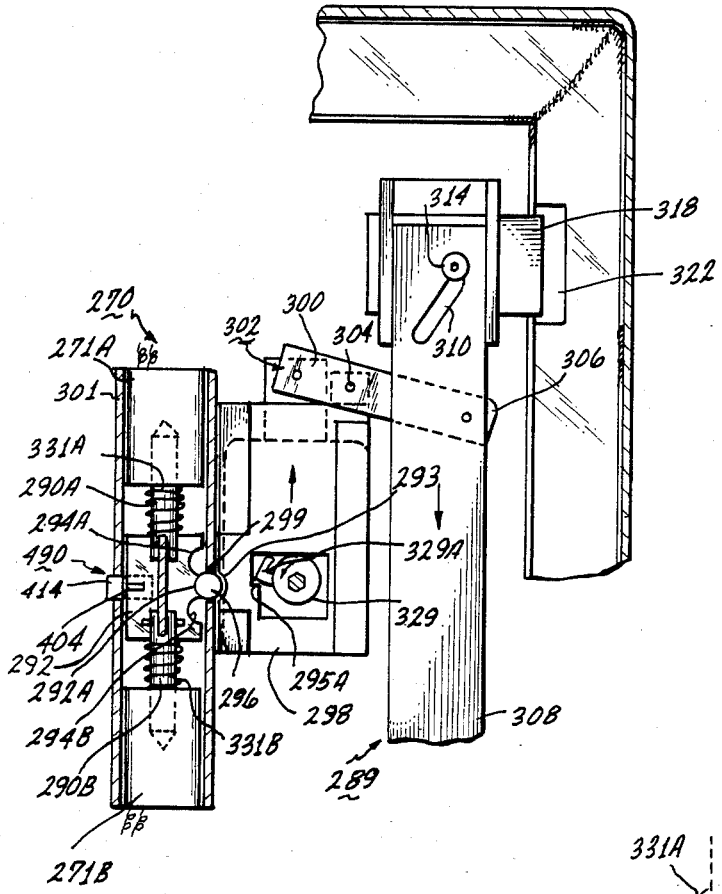
FIG. 3 is a fragmentary elevational view of the upper right-hand corner of the inside of the safe of FIG. 2, showing the rear side of the safe door in its closed and locked position.
Figure 4:
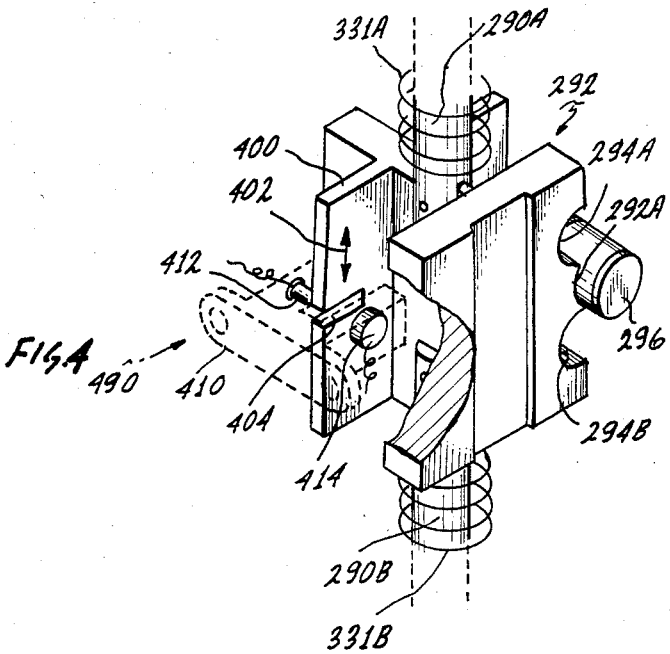
FIG. 4 is an enlarged pictorial fragmentary view of the redundant locking apparatus of FIG. 2.
Figure 5:
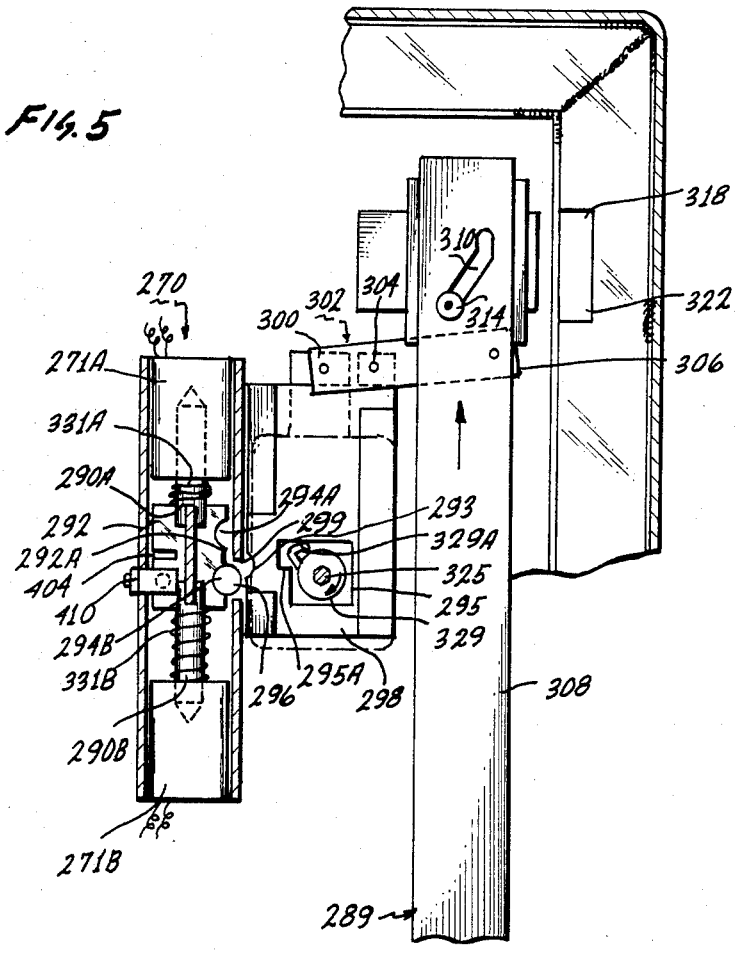
FIG. 5 is a fragmentary elevational view of the inside of the safe, similar to FIG. 3, showing the safe in an unlocked condition.

Considering the redundant locking system 227 in greater detail with reference to FIGS. 3, 4 and 5, the system 227 includes an elongated tubular housing 301 attached by a suitable means, such as bolts (not shown) to the rear of the safe door in a position adjacent boltworks latching mechanism generally indicated at 289. Double acting control mechanism designated generally at 270, includes a pair of piston cylinder assemblies 271A and 271B in the form of solenoid assemblies, disposed in face-to-face opposition to one another. Plungers 331A and 331B are aligned and attached to the opposite ends of a slidably mounted elongated shuttle 292 so that by actuating the solenoid assemblies alternatingly, the plungers can be reciprocated independently and extensively toward and away from the other assembly alternatingly, along a rectilinear path of travel. Thus, the shuttle 292 is moved by one or the other of the two solenoid assemblies, each time the correct access code is entered in the key pad on the front of the door. The solenoid assemblies are secured within opposite ends of the housing, and they selectively and alternatingly control of the position of shuttle 292.

Springs 290A and 290B bias the shuttle in a central locking position as shown in FIG. 3, opposite a side opening 299 in the housing. The spring tension is selected to offset the weight of the plungers and the shuttle to maintain the shuttle in the central locking position, shown when the solenoids are not activated. This is necessary in the illustrated arrangement, since the housing 301 is mounted vertically. That is, the shuttle travels along a generally vertical path extending between the two solenoids.

In an alternate embodiment (not shown), the housing 301 is mounted so that the path of travel is generally horizontal, to alleviate the requirement for offsetting the weight of the shuttle and plungers.

In the locked position (FIG. 3), a roller or pin 296 is disposed in the side opening 299 and it extends between a small semi-circular locking cam surface in the form of a notch or cove 292A in the side of shuttle 292 and a small keeper notch 293 in an adjacent reciprocatively slidable bar 298, to prevent the bar 298 from moving up or down, thereby preventing the latching mechanism 289 from moving. Shuttle 292 also includes two large spaced apart notches or cover 294A and 294B in the side thereof, contiguous to the small notch 292A on opposite sides thereof, and which receive the pin 296 in the retracted position of shuttle 292 as illustrated in FIG. 5. As the pin 296 is cammed out of the smaller keeper notch 293 in an adjacent reciprocatively slidable bar 298, it enters either one of the large semi-circular cam surfaces in the form of notches 294A or 294B. The bar 298 is thus free to move up to release the latching mechanism 289, so that it can be manually moved to the unlocked position illustrated in FIG. 5, in a similar manner as described in the parent application.

In operation, electrical control circuitry alternatingly and independently energizes solenoid assemblies 271A and 281B to release the locking arrangement. For example, entering the correct access code in the key pad results in solenoid assembly 271A being energized. In this manner, for example, shuttle 292 is moved to the unlocking position position illustrated in FIG. 5. In this position, pin 296 is urged into engagement with notch 294 away from keeper notch 293 and inwardly of the housing 301, when bar 298 is moved upwardly in response to manual movement of the knob on the front of the door.

When solenoid 271A is de-energized, shuttle 292 returns to a central position as shown in FIG. 3 with roller 296 urged into engagement with notch 292A on shuttle 292 when keeper notch 293 on slide bar 298 returns to the locked position (FIG. 3). With the plunger in this central position, slide bar 298 is restrained from moving.

The next time entry is gained, the electrical control circuitry energizes solenoid 271B which moves shuttle 292 from the central locking position illustrated in FIG. 3, toward solenoid 271B so that pin 296 is free to engage the cover 294A once the slide 298 is moved upwardly to urge the roller away from keeper notch 293, to once again release the locking mechanism.

Thus, the system alternatingly uses first one solenoid assembly, then the other. In the event one solenoid assembly malfunctions, the apparatus will fail to release the door one time, but then it will function properly the next, so that entry can still be gained electrically. In this way, a user is alerted to the need for repair, and yet the electronic access is still available substantially unimpaired.

Referring to FIG. 4, there is shown a position sensing device 490 for detecting when roller 296 is properly seated within the central locking notch 292A and within keeper notch 293. In this manner, it can be determined that the safe is properly locked. Flange portion 400 of shuttle 292 moves in the direction indicated by arrow 402 within the sensing device 490. Notch or opening 404 in flange portion 400 moves back and forth correspondingly, and is aligned with the locking notch 292A, to enable the device 490 to generate a signal when it detects the presence of the notch 404.

Support structure 410 which is mounted by suitable means (not shown) to housing 301 in a selected position relative to flange portion 400, straddles the position notch 404 occupies when shuttle 292 is in the central locked position. Light emitting diode 412 and detector (photo transistor) 414 are mounted on support structure 410 in the position shown in FIG. 4, so that flange portion 400 blocks the passage of light from light emitting diode 412 to detector 414, unless notch 404 is in a position corresponding to shuttle 292 being in the central locked position. Suitable known electronic circuitry means (not shown) may be employed to energize light emitting diode 412 and to sense whether or not light emitted therefrom is detected by detector 414.

Figure 6:
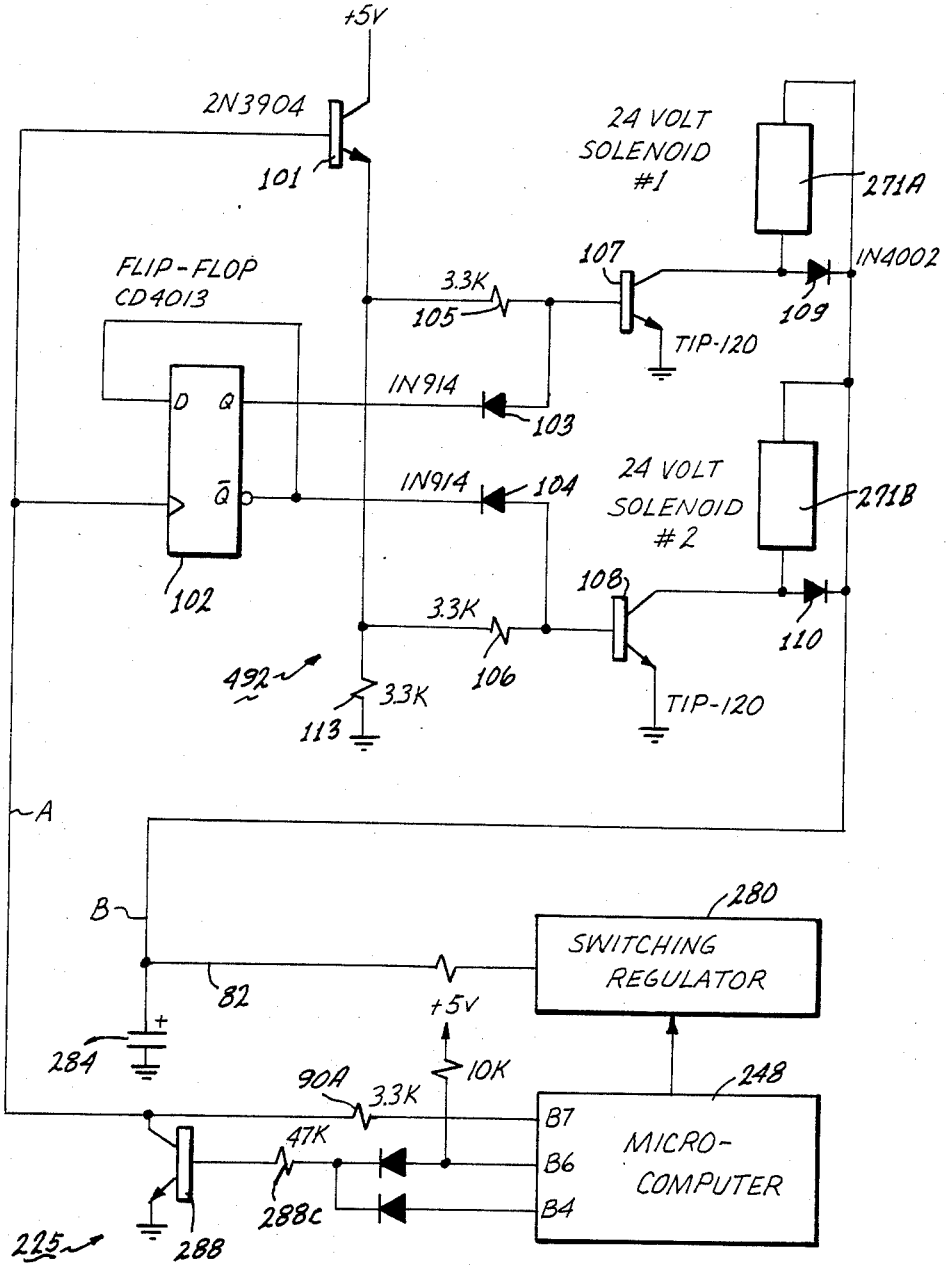
FIG. 6 is a schematic circuit diagram of the piston cylinder assembly driver circuit of the electrical control circuitry for the apparatus of FIG. 2.

Referring now to FIG. 6, there is shown a dual solenoid driver circuit 492 of the electrical control circuit 225. This driver circuit generates a control signal which alternatingly energizes first one solenoid assembly and then the other. Details of the control circuit for the electrically controlled locking apparatus are set forth in the foregoing mentioned co-pending parent parent application where they are described with reference to FIGS. 3-9 of that application. Reference may be made to FIG. 7 of the parent application, for interconnections with the dual solenoid driver circuitry shown in FIG. 6 of this application.

The dual solenoid driver circuit 492 eliminates the need for components 87, 89, 90, 91, and 94 in FIG. 7 of the parent application and they should be omitted when the redundant system 227 of the present invention is employed.

When the solenoid driver circuit 492 is activated, only one of the two solenoid assemblies is energized for each release sequence. When a release sequence is desired and an activation signal is applied to point A of the solenoid driver circuit, then one of the two solenoid assemblies is selected and that solenoid assembly is energized and remains active, until the activation signal at point A is removed to complete the release sequence. Upon request of the next release sequence, the driver control circuit selects the other solenoid assembly to perform the release sequence. Each successive release sequence alternates between the solenoid assemblies.

In order to activate either solenoid assembly, several conditions must be met as more fully described in the parent application. When the solenoid driver circuit is inactive, the signal at point A from output B7 of microcomputer 248, renders transistor 101 non-conductive to remove power from circuit 492. Transistor 101 being non-conductive allows resistor 113 to bias the voltage potential of the bases of transistors 107 and 108, to ground potential via resistors 105 and 106 respectively.

This renders transistors 107 and 108 non-conductive, thereby causing the solenoid assemblies to be un-energized.

When the solenoid driver circuit is activated by the control input signal at point A, this renders transistor 101 conductive to supply power to the circuit 492. The collector of transistor 101 is connected to a 5 volt potential, and being conductive, provides a current potential to the bases of transistors 107 and 108 via resistors 105 and 106 respectively. Depending on the state of flip-flop 102, one of the transistors 107 or 108 is rendered conductive via a current path including one of resistors 105 or 106 respectively. Thus, only one of the transistors is made conductive during a release sequence, since the diodes 103 and 104 otherwise inhibit the respective transistor from becoming conductive.

When one of the two transistors 107 or 108 conducts, the solenoid assembly 111 or 112 is activated. The emitters of transistors 107 and 108 are grounded to provide the concurrent path from the conditioned high-volt circuit at point B through the solenoid assemblies to ground, when the selected transistor is made conductive. Two appropriately poled diodes 109 and 110 are each connected between point B and the bottom ends of the solenoid assemblies. Thus, these diodes are connected between the collectors of transistors 107 and 108 and the conditioned high-volt circuit at point B.

Referring back to the diodes 103 and 104, the diodes 103 and 104 are made to conduct by the present state of the outputs of flip-flop 102, Q and Q'. The Q and Q' provide two complementary signals, either high and low or low and high, to provide and enable an inhibit signal for each of the diodes. Each time the activation signal at point A transitions from a low to a high level, the flip-flop flips to the alternate state providing the alternate selection of solenoids.

During a door releasing sequence, the switching regulator 280 of the circuit 225, charges the capacitor 284. Once all conditions for releasing the door have been satisfied prior to discharging the capacitor below a predetermined threshold, as explained in the parent application, signal 87 goes high and signals 84 and 86 go low to cause transistor 288 to be rendered non-conductive, for sending signal 87 to be supplied to the circuit 492 to render transistor 101 conductive and to cause flip-flop 102 to change states. In so doing, one of the transistors 107 and 108 becomes conductive, and thus the capacitor 284 discharges through one of the solenoid assemblies 271A or 271B to activate it. Thereafter, the conditioned signals 84 and 86 go high and signal 87 goes low to turn off the circuit 492, after a time delay interval sufficient to permit the safe door to be released.

While a particular embodiment of the present invention has been discussed, it is to be understood that various different modifications are possible and are contemplated within the true spirit and scope of the appended claims. There is no intention, therefore, of limitation to the exact abstract or disclosure herein presented.

What is claimed is:

1. System for releasing a locking arrangement for a closure member in response to electrical control means, comprising:

a housing;

a pair of first and second piston cylinder assemblies facing one another and disposed in alignment with one another within said housing for actuating alternatingly in response to the control means, said assemblies having reciprocatively mounted plungers for moving extensively toward and away from one another along a rectilinear path of travel;

shuttle means slidably mounted within said housing and connected on opposite sides thereof to the distal ends of said plungers to move toward an actuated one of said assemblies;

locking roller means;

locking cam means disposed on said shuttle means for receiving said locking roller means to position it partially outwardly of said housing within a side opening therein;

a pair of first and second unlocking cam means disposed on opposite sides of said locking cam means for enabling said roller means to move inwardly of said housing when either one of said assemblies is activated; and the locking arrangement includes a locking mechanism having a slide member adapted to be moved manually for releasing the closure member, said slide member having means defining an opening therein for receiving said roller means to lock the closure member.

2. System according to claim 1, wherein each one of said piston cylinder assemblies includes an electrical solenoid.

3. System according to claim 1, wherein the locking roller means is shaped and dimensioned to fit loosely within the side opening to enable the locking cam means to position the locking roller means partially outwardly of the housing.

4. System according to claim 1, wherein said housing includes an elongated tube, and said tube is rectangular in cross-section throughout its length.

5. System according to claim 4, wherein said shuttle means includes a block having said cam means disposed in the side thereof.

6. System according to claim 1, further comprising:

spring biasing means for biasing the shuttle in a central locked position when neither one of the piston cylinder assemblies is actuated.

7. System according to claim 6, wherein the spring biasing means comprises:

a first spring mounted between the first piston cylinder assembly and the shuttle; and a second spring mounted between the second piston cylinder assembly and the shuttle, the second spring being shaped and dimensioned to exert a slightly larger force against the shuttle than the first spring to offset the combined weight of the shuttle and plungers and bias the shuttle in a central locked position when neither one of the piston cylinder assemblies is actuated.

8. System according to claim 1, further including position sensing means for detecting when said roller means is properly engaging said locking cam means to generate a signal for the control circuit.

9. System according to claim 8, wherein the position sensing means comprises:

the shuttle having a portion defining an opening; and detecting means for detecting when the opening is in a position corresponding to the shuttle being in a central locked position.

10. System according to claim 9, wherein the detecting means includes light emitting means and light detector means mounted on the housing in positions on opposite sides of the opening.

11. System for enabling electrically the release of a locking arrangement, which comprises:

a shuttle member movably mounted to enable generally rectilinear movement of the shuttle adjacent to a selected locking arrangement between an intermediate locked position and a pair of first and second unlocked positions on opposing sides of the locked position, the shuttle member including locking means for preventing release of the locking arrangement when the shuttle member is in the locked position and unlocking means for enabling the release of the locking arrangement when the shuttle member is in either one of the first and second unlocked positions;

biasing means for urging resiliently the shuttle into the locked position;

first means responsive to a first control signal for moving the shuttle member selectively in opposition to the biasing means from the locked position to the first unlocked position;

second means responsive to a second control signal for moving the shuttle member selectively in opposition to the biasing means from the locked position to the second unlocked position; and means for supplying said first and said second control signals alternatingly to the respective first and second means each time a correct attempt is made to release said locking arrangement.

12. System as recited in claim 11, further comprising:

electrical control means for alternatingly actuating each of the pair of the electromechanical devices.

13. System as recited in claim 11, further comprising:

position sensing means for detecting when the shuttle is in the locked position.

14. System as recited in claim 13, wherein the position sensing means includes light emitting means and light detector means mounted adjacent the shuttle member in position straddling an opening in the shuttle member for sensing when the opening is in a position corresponding to the shuttle member being in the locked position.

15. System as recited in claim 11, wherein the locking means includes:

a roller; and locking cam means disposed on the shuttle member for positioning the roller in a position disabling the locking arrangement.

16. System as recited in claim 15, wherein the unlocking means includes a pair of first and second unlocking cams disposed on opposite sides of the locking cam for enabling the roller to move from the position disabling the locking arrangement to a position enabling release of the locking arrangement.

17. System as recited in claim 11, wherein the moving means associated with a first one of the pair of electromechanical devices includes means for selectively moving the shuttle member in a first direction and the moving means associated with a second one of the pair of electromechanical devices includes means for moving the shuttle member in a second direction.

18. System as recited in claim 17, wherein the first direction and second direction are generally opposite one another.

19. System as recited in claim 18, wherein the pair of electromechanical devices comprise a pair of electrical solenoids mounted in opposing face-to-face relation.

* * * * *

UNITED STATES PATENT OFFICE

CERTIFICATE OF CORRECTION

PATENT NO. : 4,671,086

DATED : June 9, 1987

INVENTOR(S) : H. Frank Fogleman

It is certified that error appears in the above-identified patent and that said Letters Patent are hereby corrected as shown below:

Column 5, Line 56; "289" should read --389--.
Column 5, Line 61; "281B" should read --271B--.
Column 7, Line 61; "87" should read --B7--.
Column 7, Line 61; "84 and 86" should read --B4 and B6--.
Column 7, Line 63; "87" should read --B7--.
Column 8, Line 1; "84 and 86" should read --B4 and B6--.
Column 8, Line 1; "87" should read --B7--.

Signed and Sealed this

Third Day of November, 1987

*Attest:*

DONALD J. QUIGG

*Attesting Officer*

*Commissioner of Patents and Trademarks*